US010537222B2

(12) United States Patent
Teshima et al.

(10) Patent No.: US 10,537,222 B2
(45) Date of Patent: Jan. 21, 2020

(54) CLEANING SHEET AND CLEANING INSTRUMENT

(71) Applicant: UNICHARM CORPORATION, Shikokuchuo-shi, Ehime (JP)

(72) Inventors: Midori Teshima, Kanonji (JP); Tomokazu Suda, Kanonji (JP); Akane Komatsu, Kanonji (JP)

(73) Assignee: UNICHARM CORPORATION, Ehime (JP)

( * ) Notice: Subject to any disclaimer, the term of this patent is extended or adjusted under 35 U.S.C. 154(b) by 332 days.

(21) Appl. No.: 15/502,485

(22) PCT Filed: Jul. 14, 2015

(86) PCT No.: PCT/JP2015/070181
§ 371 (c)(1),
(2) Date: Feb. 7, 2017

(87) PCT Pub. No.: WO2016/021377
PCT Pub. Date: Feb. 11, 2016

(65) Prior Publication Data

US 2017/0215685 A1 Aug. 3, 2017

(30) Foreign Application Priority Data

Aug. 8, 2014 (JP) ..... 2014-163136

(51) Int. Cl.
*A47L 13/16* (2006.01)
*A47L 13/44* (2006.01)
(Continued)

(52) U.S. Cl.
CPC ..... *A47L 13/16* (2013.01); *A47L 13/38* (2013.01); *A47L 13/44* (2013.01); *A47L 13/46* (2013.01)

(58) Field of Classification Search
CPC ..... A47L 13/16; A47L 13/38; A47L 13/46; A47L 13/44
See application file for complete search history.

(56) References Cited

U.S. PATENT DOCUMENTS 7,383,602 B2 * 6/2008 Tanaka ..... A47L 13/24 15/147.2
7,788,759 B2 * 9/2010 Yang ..... A46B 3/06 15/226
(Continued)

FOREIGN PATENT DOCUMENTS

DE 202004018160 U1 4/2005
EP 2080471 A1 7/2009
(Continued)

OTHER PUBLICATIONS

Office Action in JP Application No. 2014-163136, dated Aug. 14, 2018, 5pp.
(Continued)

*Primary Examiner* — Laura C Guidotti
(74) *Attorney, Agent, or Firm* — Hauptman Ham, LLP

(57) ABSTRACT

A cleaning sheet includes an aperture and a housing space. The housing space further includes a first space region, and a second space region which is shorter than the first space region. The first space region is disposed closer to the aperture than the second space region.

11 Claims, 17 Drawing Sheets

(51) Int. Cl.
*A47L 13/38* (2006.01)
*A47L 13/46* (2006.01)

(56) References Cited

U.S. PATENT DOCUMENTS

| | | | |
|---|---|---|---|
| 2002/0148061 | A1 | 10/2002 | Tanaka et al. |
| 2005/0005381 | A1 | 1/2005 | Tanaka et al. |
| 2006/0168751 | A1 | 8/2006 | Lin et al. |
| 2007/0033761 | A1 | 2/2007 | Yang et al. |
| 2008/0235891 | A1 | 10/2008 | Tsuchiya et al. |

FOREIGN PATENT DOCUMENTS

| | | | |
|---|---|---|---|
| EP | 2532294 | A1 | 12/2012 |
| JP | 11-89776 | A | 4/1999 |
| JP | 2007-135774 | A | 6/2007 |
| JP | 2008-253286 | A | 10/2008 |
| JP | 2011-156294 | A | 8/2011 |
| TW | 552124 | B | 9/2003 |

OTHER PUBLICATIONS

Office Action in CN Application No. 201580048243.5, dated Jul. 25, 2018, 13pp.
International Preliminary Report on Patentability in PCT Application No. PCT/JP2015/070181, dated Feb. 23, 2017, 11pp.
Extended European Search Report in EP Application No. 15830105.1, dated Feb. 22, 2018, 8pp.
International Search Report dated Oct. 20, 2015, in International Application No. PCT/JP2015/070181.
Office Action in TW Application No. 104124393, dated Apr. 30, 2019, 10pp.
Office Action in AU Application No. 2015300411, dated May 8, 2019, 4pp.
Office Action in PH Application No. 1/2017/500211, dated Jul. 9, 2019, 5pp.

* cited by examiner

CLEANING SHEET AND CLEANING INSTRUMENT

RELATED APPLICATIONS

The present application is a National Phase of International Application Number PCT/JP2015/080181, filed Jul. 14, 2015, which claims priority to Japanese Application Number 2014-1463136, filed Aug. 8, 2014.

TECHNICAL FIELD

The present invention relates to a cleaning sheet and a cleaning tool for cleaning an object to be cleaned. This application claims priority based on Japanese Patent Application No. 2014-163136 filed Aug. 8, 2014, the disclosure of which is incorporated herein by reference in its entirety.

BACKGROUND ART

Japanese Unexamined Patent Application Publication JP2008-253286 A discloses a cleaning tool having a cleaning element and a cleaning element holder. The cleaning element is attached to a holding plate of the cleaning element holder. In this disclosure of the cleaning tool, however, no description is provided relating to whether the cleaning element can be easily attached to the cleaning element holder and whether the cleaning element and the cleaning element holder do not easily become detached from each other. In these points, further improvement is required.

PRIOR ART DOCUMENT

Patent Document

Patent Document 1: JP2008-253286 A

SUMMARY OF THE INVENTION

Problem to be Solved by the Invention

Accordingly, it is an object of the present invention to provide a more rational constructing technique for a cleaning sheet and a cleaning tool.

Embodiments for Solving the Problem

In order to solve the above problem, according to the present invention, a cleaning sheet is provided which is configured to be attached to a holder. The cleaning sheet has sheet-like members, a receiving part configured to receive the holder by superposing the sheet-like members, and a bonded part that defines an outer edge of the receiving part by bonding the superposed sheet-like members. An insertion direction of the holder in the receiving part defines a first axis, a direction opposite to the insertion direction in the direction of the first axis defines a removal direction, and a direction crossing the first axis defines a second axis. The receiving part has an opening and a receiving space formed contiguously to the opening and extending in the direction of the first axis. The receiving space has a first space region having a prescribed width and a second space region having a smaller width than the first space region, in the direction of the second axis. The first space region is disposed closer to the opening than the second space region in the direction of the first axis.

According to this invention, with the structure having the first space region formed contiguously to the opening, a user can easily insert the holder into the receiving part when attaching the holder to the receiving part. Further, with the structure having the second space region, the holder can be locked by the second space region during cleaning operation. Thus, the cleaning sheet and the holder are prevented from becoming detached from each other during cleaning operation.

According to a further aspect of the cleaning sheet of the present invention, the opening may include a first opening, a second opening formed on the opposite side to the first opening in the direction of the first axis, a first opening-side region including the first opening and a second opening-side region including the second opening. Further, the first space region and the second space region may be both formed in the first opening-side region and the second opening-side region.

According to this aspect of the invention, the first opening and the second opening can be selectively used by a user, so that the usability is improved. Further, with the structure in which the first opening and the second opening have the first opening-side region and the second opening-side region, respectively, the holder can be easily inserted into the cleaning sheet whichever opening the user choose. Furthermore, the cleaning sheet is configured such that the cleaning sheet and the holder are prevented from easily becoming detached from each other during cleaning operation.

According to a further aspect of the cleaning sheet of the present invention, the receiving part may have a guide part configured to guide the holder. The guide part may be formed by a region extending from the first space region to the second space region.

According to this aspect of the invention, the holder can be guided by the guide part when the holder is moved from the first space region to the second space region having a smaller width than the first space region in the direction of the second axis. Therefore, the user can easily insert the holder into the cleaning sheet.

According to a further aspect of the cleaning sheet of the present invention, the receiving part may have a high rigidity part having higher rigidity than the other parts in the receiving part, and the high rigidity part may be formed in the second space region.

According to this aspect of the invention, the high rigidity part prevents the receiving part from deforming when the holder is moved from the first space region to the second space region.

According to a further aspect of the cleaning sheet of the present invention, the receiving part may have a first bonded part which defines the first space region and a second bonded part which defines the second space region.

According to a further aspect of the cleaning sheet of the present invention, the holder may have a projection, and the receiving part may form a projection receiving region for receiving the projection between the first bonded part and the second bonded part.

According to a further aspect of the cleaning tool of the present invention, the bonded part may have an insertion-side region which gets into contact with the holder when the holder is moved in the insertion direction to be received in the receiving part, and a removal-side region which gets into contact with the holder when the holder received in the receiving part is moved in the removal direction.

The insertion-side region defines an insertion starting point with which the holder moving in the insertion direction first gets into contact, an insertion end point which is an end point of contact of the holder moving in the insertion direction, a first insertion line connecting the insertion starting point and the insertion end point, a second insertion line passing through the insertion starting point along the second axis, and an insertion angle made by the first insertion line and the second insertion line.

The removal-side region defines a removal starting point with which the holder moving in the removal direction first gets into contact, a removal end point which is an end point of contact of the holder moving in the removal direction, a first removal line connecting the removal starting point and the removal end point, a second removal line passing through the removal end point along the second axis, and a removal angle made by the first removal line and the second removal line.

Further, the insertion angle is formed to be smaller than the removal angle.

According to this aspect of the invention, with the structure in which the holder gets into contact with the insertion-side region when the holder is inserted into the cleaning sheet, the holder can be easily attached to the cleaning sheet. Further, with the structure in which the holder gets into contact with the removal-side region when the holder is removed from the cleaning sheet, the cleaning sheet and the holder are prevented from becoming detached from each other during cleaning operation.

According to a further aspect of the cleaning sheet of the present invention, the insertion-side region may include a first insertion-side region formed in the first bonded part and a second insertion-side region formed in the second bonded part. The removal-side region may include a first removal-side region formed in the first bonded part and a second removal-side region formed in the second bonded part.

According to a further aspect of the cleaning sheet of the present invention, the insertion-side region may also serve as the guide part.

According to this aspect of the invention, the holder can be smoothly inserted into the receiving part of the cleaning sheet via the insertion-side region having the insertion angle.

According to a further aspect of the cleaning sheet of the present invention, the removal-side region in the second opening-side region may form a preventing part for preventing the holder inserted from the first opening from being further inserted.

According to this aspect of the invention, the cleaning sheet is configured such that the removal-side region in the second opening-side region prevents the holder attached to the cleaning sheet from being easily removed from the cleaning sheet. Therefore, the cleaning sheet and the holder are prevented from easily becoming detached from each other during cleaning operation.

According to a further aspect of the cleaning sheet of the present invention, the receiving part may have a separation bonded part for separating the receiving space.

According to this aspect of the invention, the holder of which part to be inserted into the cleaning sheet has a bifurcated shape, for example, may be suitably used.

In order to solve the above-described problem, according to the present invention, a cleaning tool having a holder and a cleaning sheet configured to be attached to the holder is provided. The holder has a grip part to be held by a user, and a long part. The cleaning sheet has sheet-like members, a receiving part configured to receive the long part by superposing the sheet-like members, and a bonded part that defines an outer edge of the receiving part by bonding the superposed sheet-like members. An insertion direction of the long part in the receiving part defines a first axis, a direction opposite to the insertion direction in the direction of the first axis defines a removal direction, and a direction crossing the first axis defines a second axis. The receiving part has an opening and a receiving space formed contiguously to the opening and extending in the direction of the first axis. The receiving space has a first space region having a prescribed width and a second space region having a smaller width than the first space region, in the direction of the second axis. The first space region is disposed closer to the opening than the second space region in the direction of the first axis.

According to this invention of the cleaning tool, with the structure having the first space region formed contiguously to the opening, a user can easily insert the holder into the receiving part when attaching the holder to the receiving part. Further, with the structure having the second space region, the holder can be locked by the second space region during cleaning operation. Thus, the cleaning sheet and the holder are prevented from becoming detached from each other during cleaning operation.

Effect of the Invention

According to this invention, a more rational constructing technique for a cleaning tool is provided.

EMBODIMENTS FOR CARRYING OUT THE INVENTION (Brief Description of the Cleaning Sheet and the Cleaning Tool)

Figure 12:
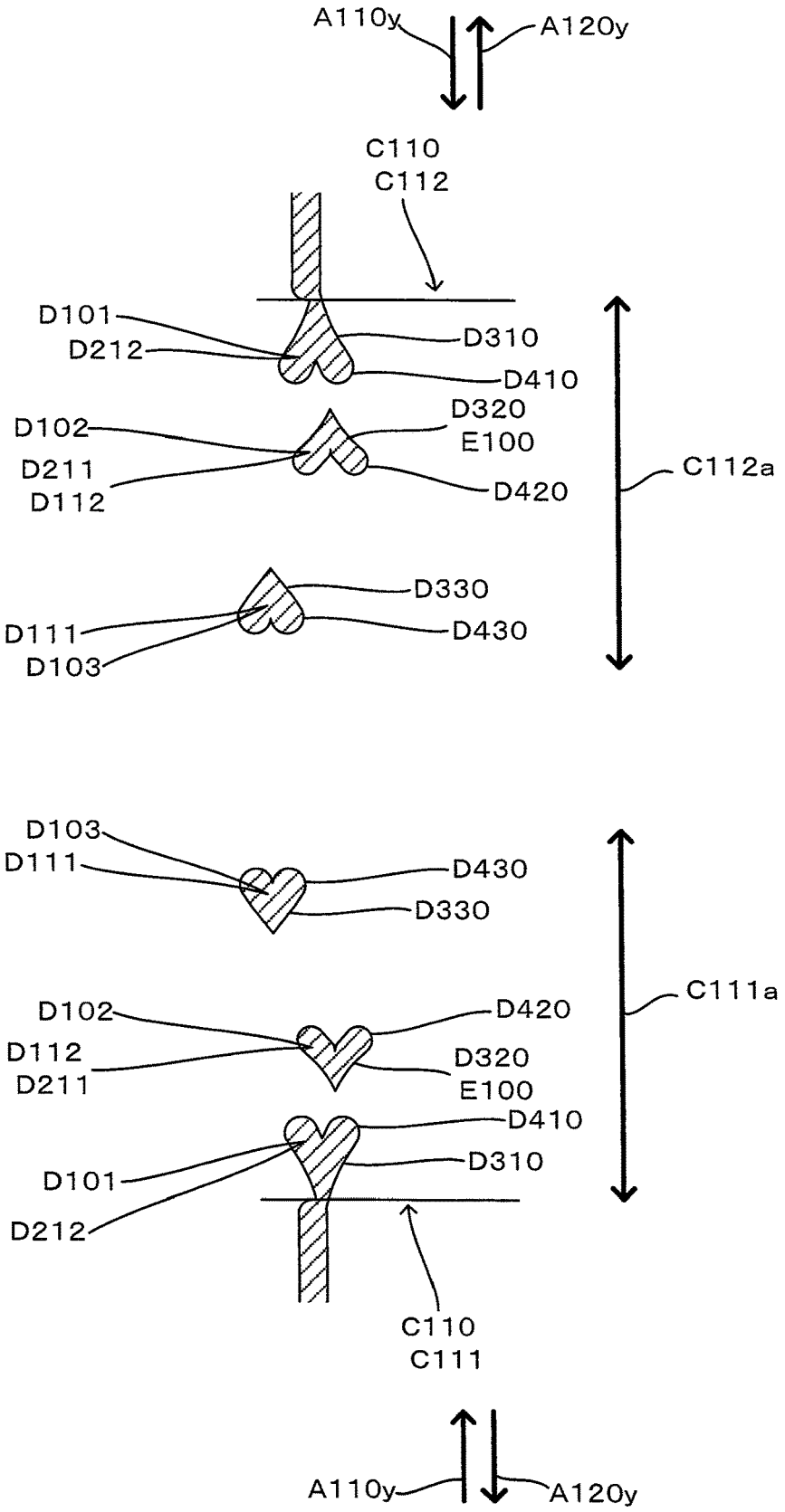
FIG. 12 is an explanatory drawing for illustrating the structures of the insertion-side region and the removal-side region in the cleaning sheet.
Figure 13:
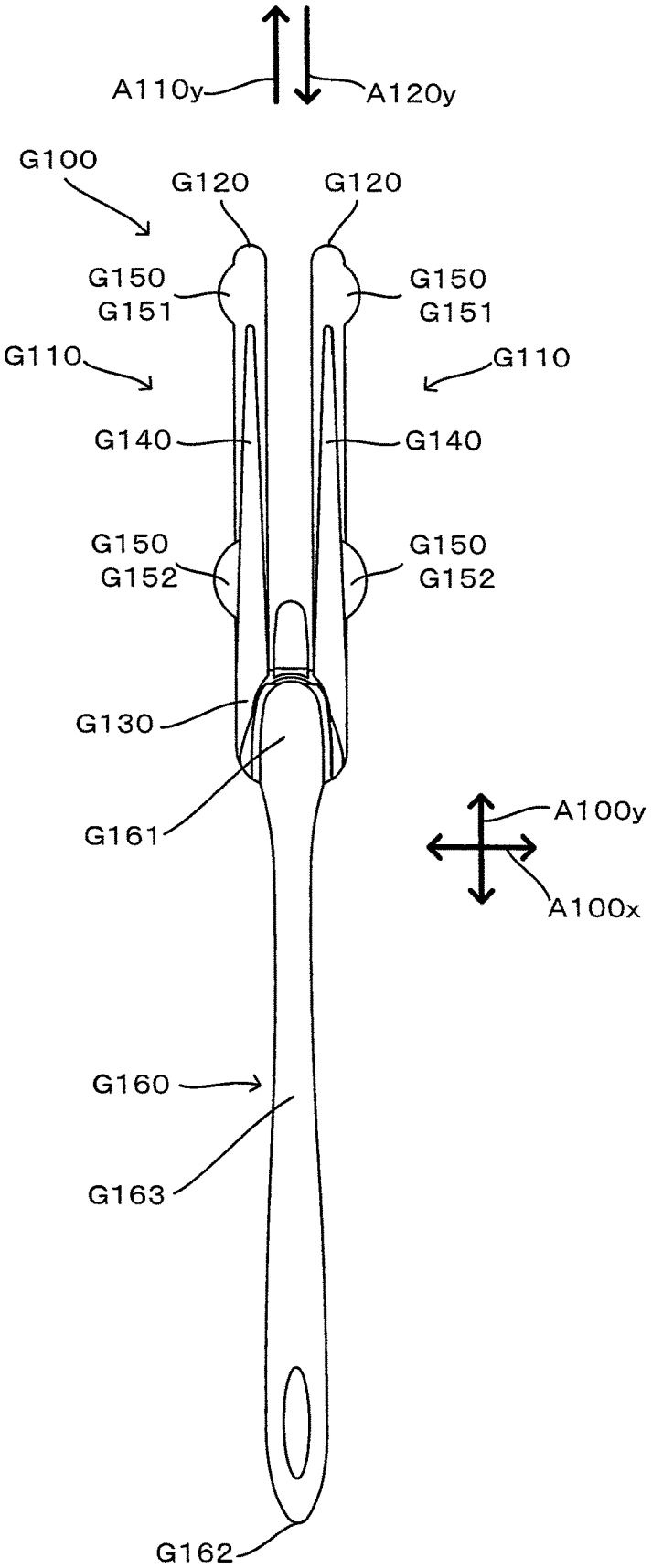
FIG. 13 is an explanatory drawing for illustrating the structure of a first holder.
Figure 14:
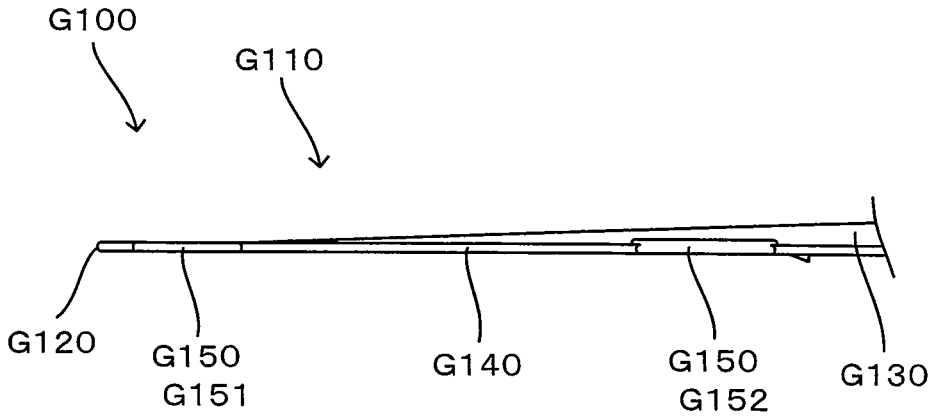
FIG. 14 is an explanatory drawing for illustrating the structure of a long part of the first holder.
Figure 15:
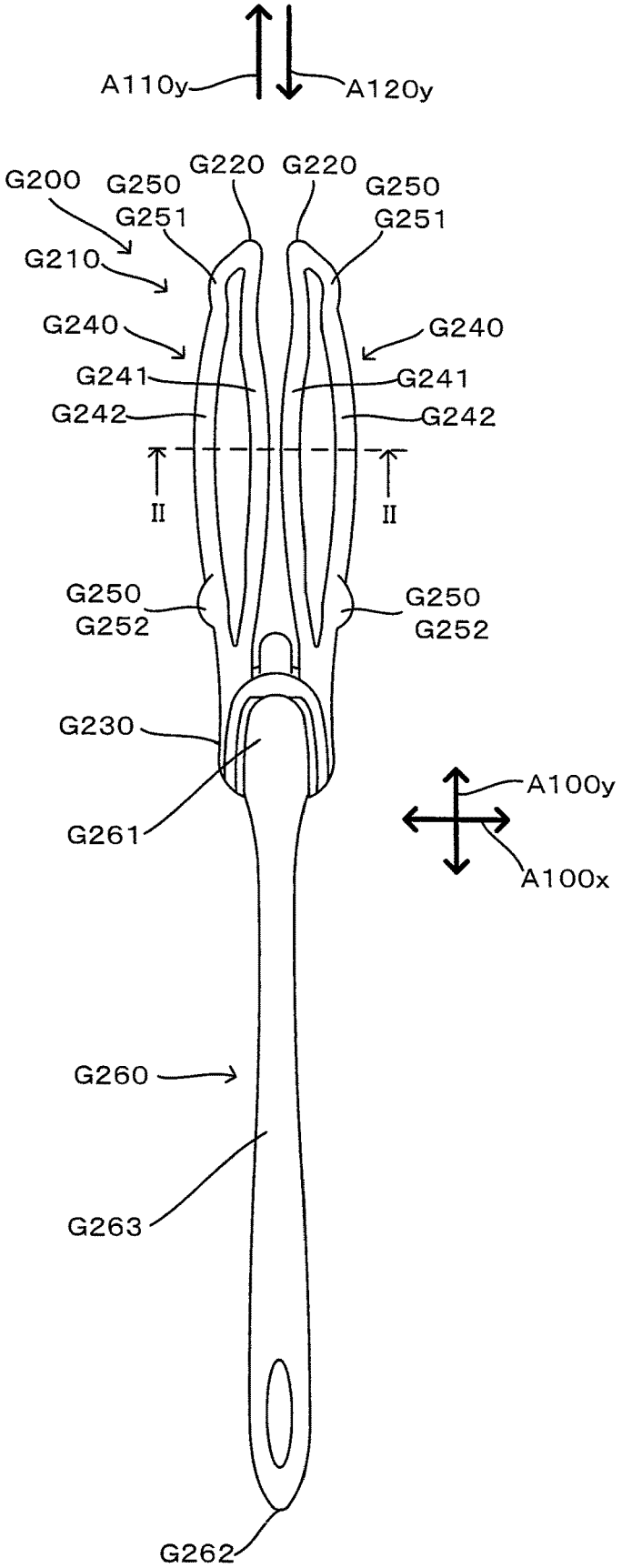
FIG. 15 is an explanatory drawing for illustrating the structure of a second holder.

Embodiments of a cleaning sheet and a cleaning tool according to the present invention are now described with reference to FIGS. 1 to 20. The cleaning tool is formed by attaching a holder G100 shown in FIG. 13 to a cleaning sheet B100 shown in FIG. 1. The cleaning sheet B100 and the holder G100 are example embodiments that correspond to the "cleaning sheet" and the "holder", respectively, according to this invention. The holder G100 includes holders of two different kinds shown in FIGS. 13 and 15 which are properly used according to the usage. For the sake of convenience, the holders shown in FIGS. 13 and 15 are respectively referred to as a first holder G100 and a second holder G200. A cleaning tool package is provided by combination of either one of the first and second holders G100, G200 and the cleaning sheet B100.

The cleaning sheet B100 may be of disposable type designed for single use, or disposable type designed for multiple use which can be used several times, while holding dust or dirt collected from a cleaning surface to be cleaned.

(Basic Structure of the Cleaning Sheet)

Figure 1:
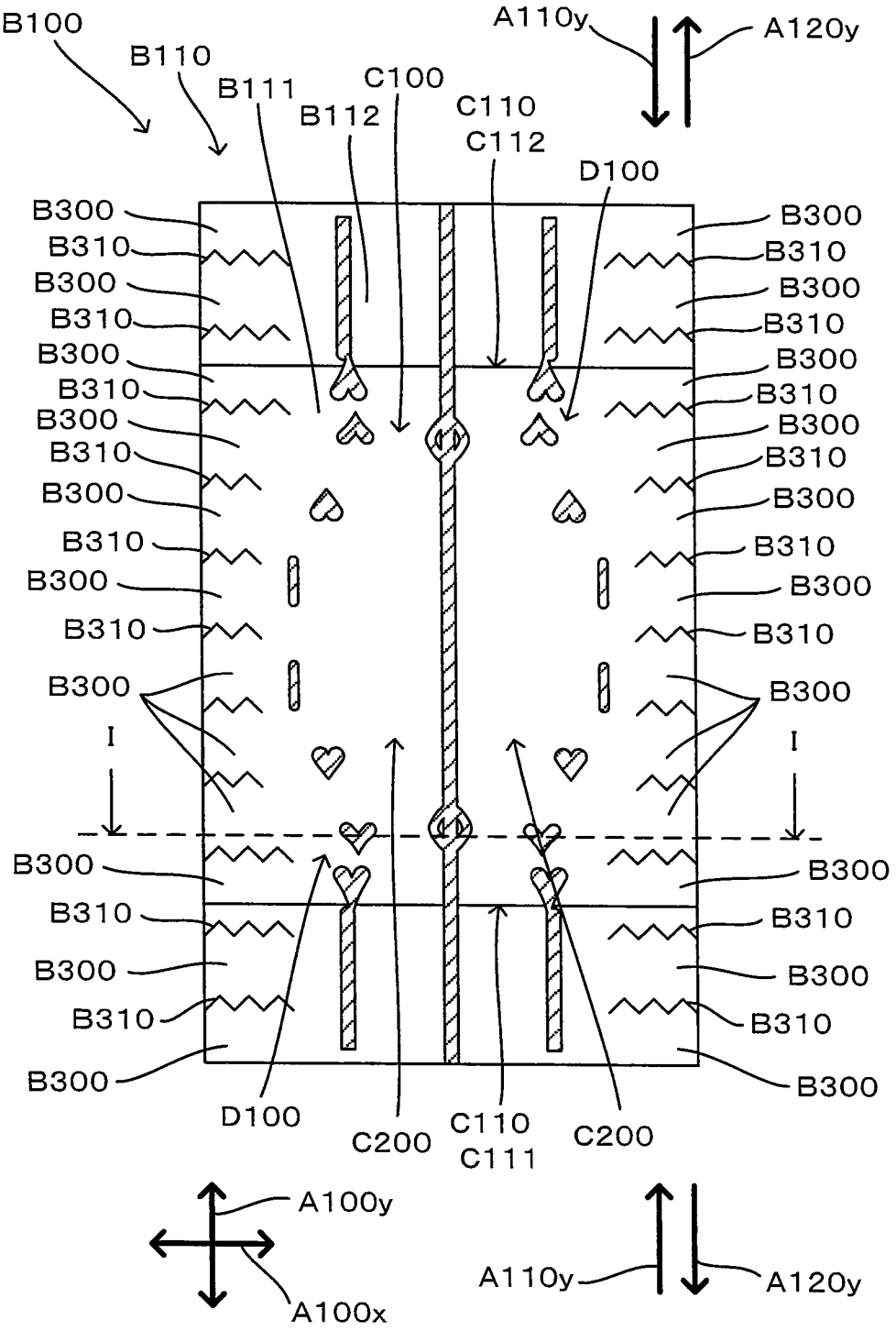
FIG. 1 is a front view showing an overall structure of a cleaning sheet according to an embodiment of the present invention.

The basic structure of the cleaning sheet B100 is now described with reference to FIGS. 1 and 2. FIG. 1 is a plan view showing the cleaning sheet B100, and FIG. 2 is a sectional view taken along line I-I in FIG. 1.

Figure 2:
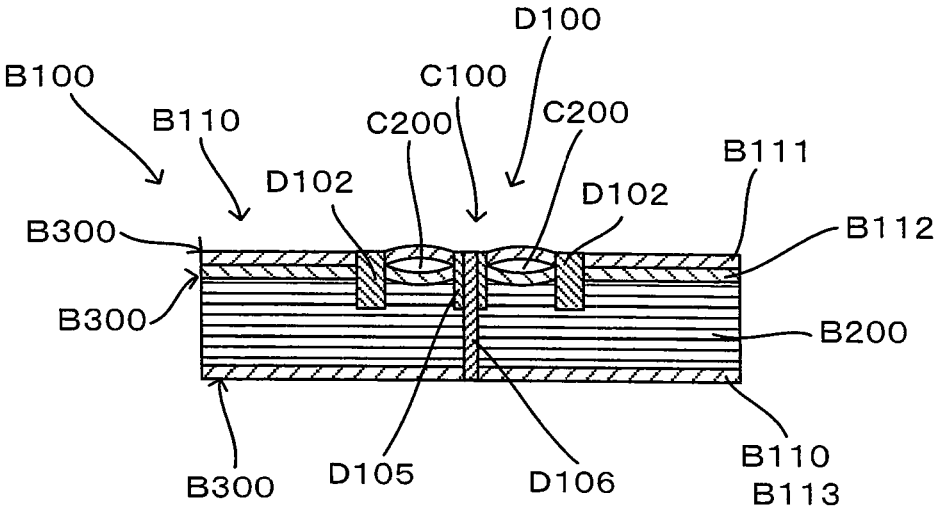
FIG. 2 is a sectional view taken along line I-I in FIG. 1.

As shown in FIG. 2, the cleaning sheet B100 includes a sheet-like member B110 and a fiber bundle B200. The sheet-like member B110 has a first sheet B111, a second sheet B112 and a third sheet B113. The first sheet B111 and the second sheet B112 are superposed one on the other. The fiber bundle B200 is disposed between the second sheet B112 and the third sheet B113. The sheet-like member B110 and the fiber bundle B200 are bonded by a prescribed bonded part D100. A receiving part C100 for receiving a long part G110 of the holder G100 shown in FIG. 13 is formed between the first sheet B111 and the second sheet B112. Further, the receiving part C100 is also capable of receiving a long part G210 of the holder G200 shown in FIG. 15. The receiving part C100 is formed by bonding the first and second sheets B111, B112 at the bonded part D100. Specifically, the bonded part D100 defines an outer edge of the receiving part C100. The structures of the bonded part D100, the receiving part C100 and the holder G100 are described below in further detail. The sheet-like member B110, the bonded part D100 and the receiving part C100 are example embodiments that correspond to the "sheet-like member", the "bonded part" and the "receiving part", respectively, according to this invention.

As shown in FIG. 1, the cleaning sheet B100 defines a first axis A100*y* parallel to an insertion direction A110*y* of the long part G110, G210 into the receiving part C100. A direction opposite to the insertion direction A110*y* in the direction of the first axis A100*y* defines a removal direction A120*y*. A direction crossing the first axis A100*y* defines a second axis A100*x*. The insertion direction A110*y*, the removal direction A120*y*, the first axis A100*y* and the second axis A100*x* are example embodiments that correspond to the "insertion direction", the "removal direction", the "first axis" and the "second axis", respectively, according to this invention.

As shown in FIG. 1, the receiving part C100 has an opening C110 and a receiving space C200 formed contiguously to the opening C110 and extending in the direction of the first axis A100*y*. The opening C110 and the receiving space C200 are example embodiments that correspond to the "opening" and the "receiving space", respectively, according to this invention. As shown in FIG. 1, the first sheet B111 is shorter than the second sheet B112 in the direction of the first axis A100*y*. The opening C110 includes a first opening C111 and a second opening C112 formed on the opposite side to the first opening C111 in the direction of the first axis A100*y*. The first opening C111 and the second opening C112 are example embodiments that correspond to the "first opening" and the "second opening", respectively, according to this invention.

The first, second and third sheets B111, B112, B113 have a plurality of cuts B310 extending in the direction of the second axis A100*x*. Strips B300 are formed between adjacent ones of the cuts B310.

The sheet-like member B110 is formed by nonwoven fabric of thermal melting fibers (thermoplastic fibers). The fibers forming the nonwoven fabric may be synthetic fibers such as polyethylene terephthalate (PET).

The sheet-like member B110 may be formed by using materials other than the nonwoven fabric, such as a cloth and a film of synthetic resin.

The fiber bundle B200 is formed by a fiber structure in order to be made capable of cleaning a subject to be cleaned. In this invention, the fiber structure refers to a structure formed of "fibers". In this invention, the "fibers" include typical single fibers, and typical fibers aligned in the length direction and/or the radial direction (twist yarn, spun yarn, yarn to which a plurality of filaments are partially connected). The "typical fiber" here refers to a component of a fiber structure such as yarn and textile and is a thin and flexible fiber having a substantially longer length compared with the thickness. Typically, a long continuous fiber is defined as a filament and a short fiber as a staple.

In the cleaning sheet B100 according to this embodiment, the fiber bundle B200 is formed by a fiber assembly of fibers having orientation in a prescribed direction. Specifically, the fiber assembly is formed by an assembly of fibers having orientation in the direction of the second axis A100*x*.

The fiber assembly is formed of layered fibers having orientation in the direction of the second axis A100*x*. The fibers are flexible and thus easily bent and deformed. Therefore, the orientation direction of the fibers refers to the fiber orientation in product design.

Preferably, the fiber assembly is an assembly of filaments made of polyethylene terephthalate (PET) and obtained by opening a tow in practical use.

(Description of the Receiving Part)

The receiving part C100 of the cleaning sheet B100 is now described with reference to FIG. 3. The outer edge of the receiving part C100 is defined by a plurality of the bonded parts D100. Further, the cleaning sheet B100 has a separation bonded part (sixth bonded part) D106 passing through its center in the direction of the second axis A100*x* and extending in the direction of the first axis A100*y*. The receiving space C200 is separated into right and left parts as viewed in FIG. 3 by the separation bonded part D106. The separation bonded part D106 is an example embodiment that corresponds to the "separation bonded part" according to this invention.

The opening C110 includes the first opening C111, the second opening C112 formed on the opposite side to the first opening C111 in the direction of the first axis A100*y*, a first opening-side region C111*a* including the first opening C111 and a second opening-side region C112*a* including the second opening C112. The first opening C111, the second opening C112, the first opening-side region C111*a* and the second opening-side region C112*a* are example embodiments that correspond to the "first opening", the "second opening", the "first opening-side region" and the "second opening-side region", respectively, according to this invention.

The receiving space C200 includes a first receiving region C310 and a second receiving region C320. The first receiving region C310 is formed for the first holder G100, and the second receiving region C320 is formed for the second holder G200.

More specifically, the first holder G100 shown in FIG. 13 has a first long part G110 to be inserted into the receiving space C200 and a first projection G150 formed on the first long part G110. The second holder G200 shown in FIG. 15 has a second long part G210 to be inserted into the receiving space C200 and a second projection G250 formed on the second long part G210. When the first holder G100 is attached to the cleaning sheet B100, the first receiving region C310 receives the first projection G150. When the second holder G200 is attached to the cleaning sheet B100, the second receiving region C320 receives the second projection G250. That "the projection is received in the receiving region" does not represent that all of the projections of the holder are received in the specific receiving region. For example, the second holder G200 has two second projections G250 as described below, but at least one of them may be received in the second receiving region C320.

The first receiving region C310 and the second receiving region C320 are adjacent to each other in the direction of the first axis A100*y*. The first receiving region C310 has a front end C311 and a rear end C312, and the second receiving region C320 has a front end C321 and a rear end C322.

(Description of the Bonded Part)

The bonded part D100 of the cleaning sheet B100 is now described with reference to FIG. 4. The bonded part D100 is formed by welding the sheet-like member B110 and the fiber bundle B200. The bonded part D100 includes a first bonded part D101, a second bonded part D102, a third bonded part D103, a fourth bonded part D104, a fifth bonded part D105 and a sixth bonded part D106. A pair of each of the first to fourth bonded parts D101, D102, D103, D104 are formed on the second axis A100*x*. The first to fifth bonded parts D101 to D105 are symmetrically arranged in the first opening-side region C111*a* and the second opening-side region C112*a*. The first bonded parts D101, the second bonded parts D102, the third bonded parts D103 and the fourth bonded parts D104 are arranged in this order when viewed from the opening C110. The fifth bonded part D105 is formed on the sixth bonded part D106 on the second axis A100*x* passing through the second bonded parts D102. Specifically, as shown in FIG. 4, the fifth bonded parts D105 and the sixth bonded part D106 are overlapped with each other.

As shown in FIG. 2, the sixth bonded part D106 bonds the first sheet B111, the second sheet B112, the fiber bundle D200 and the third sheet B113. The first to fifth bonded parts D101 to D105 bond the first sheet B111, the second sheet B112 and part of the fiber bundle B200.

Figure 4:
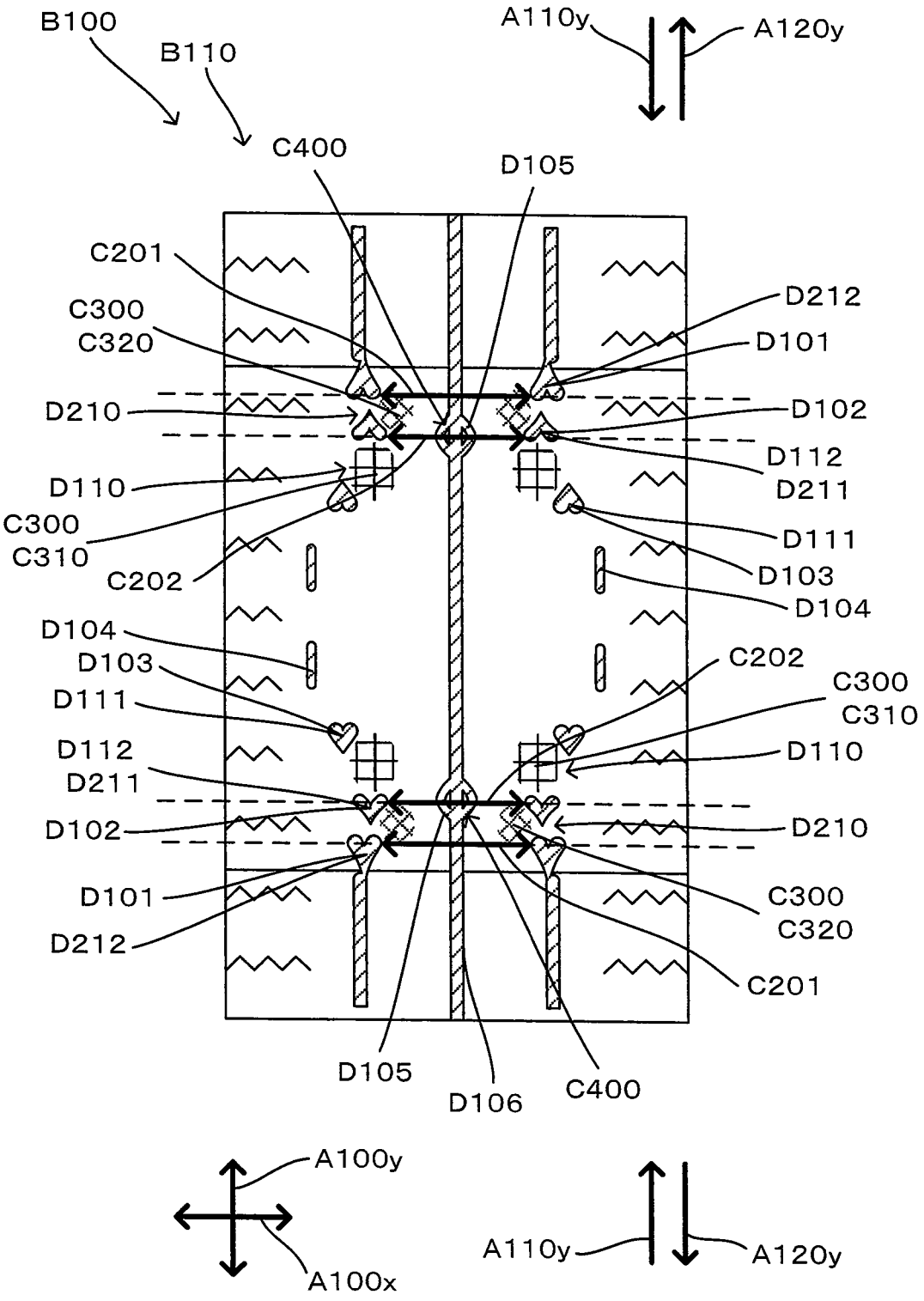
FIG. 4 is an explanatory drawing for illustrating a bonded part in the cleaning sheet.

As shown in FIG. 4, the receiving space C200 has a first space region C201 having a prescribed width and a second space region C202 having a smaller width than the first space region C201, in the direction of the second axis A100*x*. The first space region C201 is disposed closer to the opening C110 than the second space region C202 in the direction of the first axis A100*y*. The first space region C201 is defined between the pair of the first bonded parts D101. The second space region C202 is defined between the pair of the second bonded parts D102. Thus, the distance between the pair of the first bonded parts D101 is longer than the distance between the pair of the second bonded parts D102 in the direction of the second axis A100*x*. The first space region C201 and the second space region C202 are symmetrically formed in the first opening-side region C111*a* and the second opening-side region C112*a*.

The first space region C201 and the second space region C202 are example embodiments that correspond to the "first space region" and the "second space region", respectively, according to this invention.

As shown in FIG. 4, the fifth bonded part D105 is formed in the second space region C202. The fifth bonded part D105 forms a high rigidity part C400 having higher rigidity than the other parts in the receiving part C100. Here, the first to fourth bonded parts D101 to D104 forming the outer edge of the receiving part C100 are not included in "the other parts in the receiving part C100". Further, the fifth bonded part D105 is configured to be wider than the sixth bonded part D106 in the direction of the second axis A100*x*. Thus, the region of the fifth bonded part D105 (the high rigidity part C400) has higher rigidity than the other parts in the receiving part C100. The high rigidity part C400 is an example embodiment that corresponds to the "high rigidity part" according to this invention.

The first receiving region C310 receives the projection G150 of the holder G100, and the second receiving region C320 receives the projection G250 of the holder G200. Therefore, the first receiving region C310 and the second receiving region C320 can be said to be projection receiving regions.

The first receiving region C310 and the second receiving region C320 are formed by a first receiving region formation part D110 and a second receiving region formation part D210, respectively.

Figure 3:
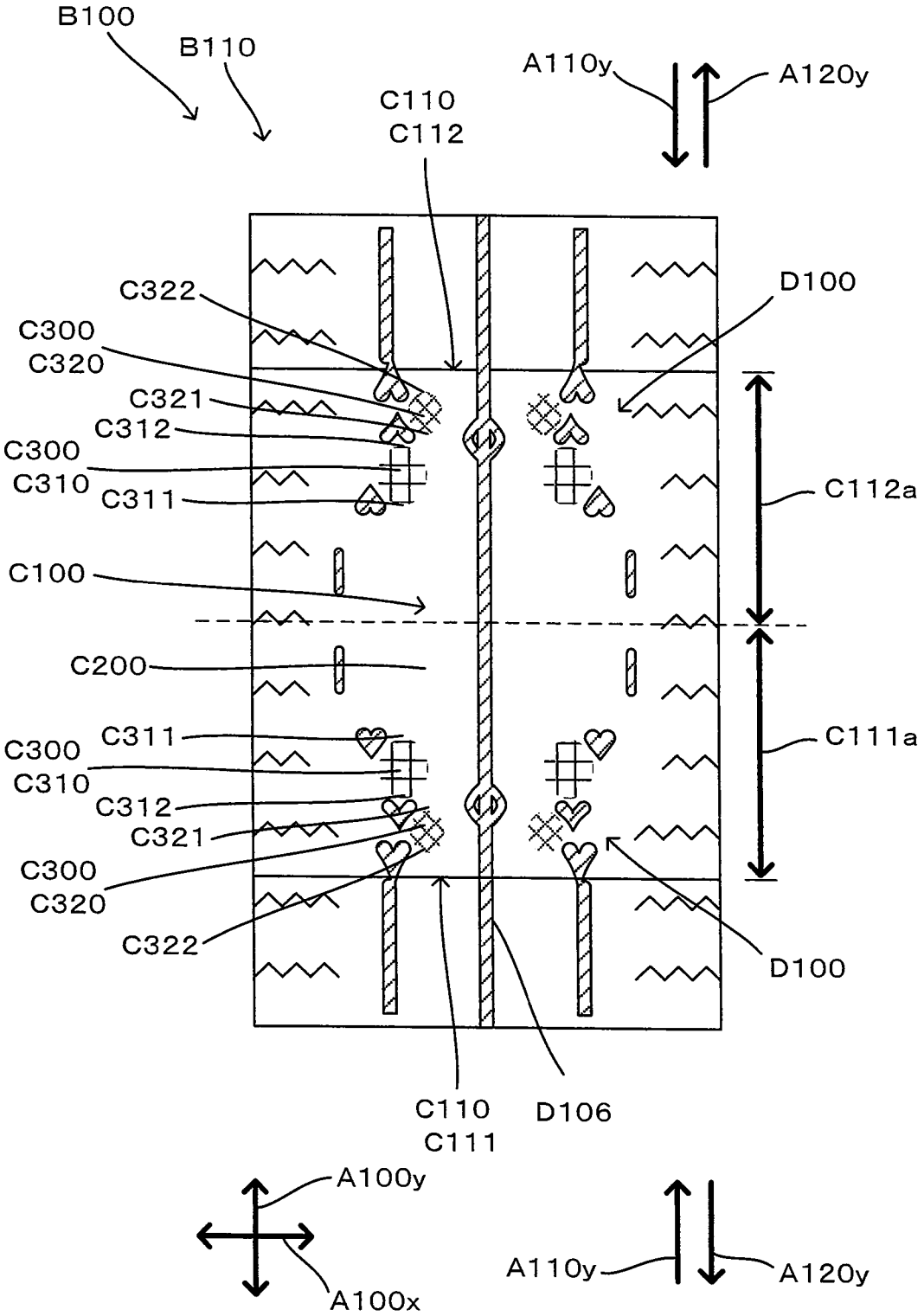
FIG. 3 is an explanatory drawing for illustrating a receiving part in the cleaning sheet.

As shown in FIG. 3, the first receiving region C310 has a front end C311 and a rear end C312, and the second receiving region C320 has a front end C321 and a rear end C322. As shown in FIG. 4, the first receiving region formation part D110 has a first front end bonded part D111 forming the front end C311 of the first receiving region C310, and a first rear end bonded part D112 forming the rear end C312 of the first receiving region C310. The first front end bonded part D111 is formed by the third bonded part D103, and the first rear end bonded part D112 is formed by the second bonded part D102. Further, the second receiving region formation part D210 has a second front end bonded part D211 forming the front end C321 of the second receiving region C320, and a second rear end bonded part D212 forming the rear end C322 of the second receiving region C320. The second front end bonded part D211 is formed by the second bonded part D102, and the second rear end bonded part D212 is formed by the first bonded part D101. Thus, the second bonded part D102 serves as both the first rear end bonded part D112 and the second front end bonded part D211. With such a structure, the first receiving region C310 and the second receiving region C320 are formed adjacent to each other.

As described above, in the embodiment of this invention, the first receiving region formation part D110 and the second receiving region formation part D210 are formed by respective pairs of bonded parts, but they may be formed by respective single bonded parts.

(Description of the Insertion-Side Region and the Removal-Side Region in the Bonded Part)

An insertion-side region D300 and a removal-side region D400 in the bonded part D100 are now described with reference to FIGS. 5 to 12. In this embodiment, the insertion-side region D300 and the removal-side region D400 which are described below are formed in the first to third bonded parts D101 to D103. Referring to FIGS. 5 to 12, the second bonded part D102 is shown and described as a representative example of the bonded parts having the insertion-side region D300 and the removal-side region D400. Further, the first holder G100 is shown and described as a representative example of the holders. The insertion-side region D300 and the removal-side region D400 are example embodiments that correspond to the "insertion-side region" and the "removal-side region", respectively, according to this invention.

Figure 5:
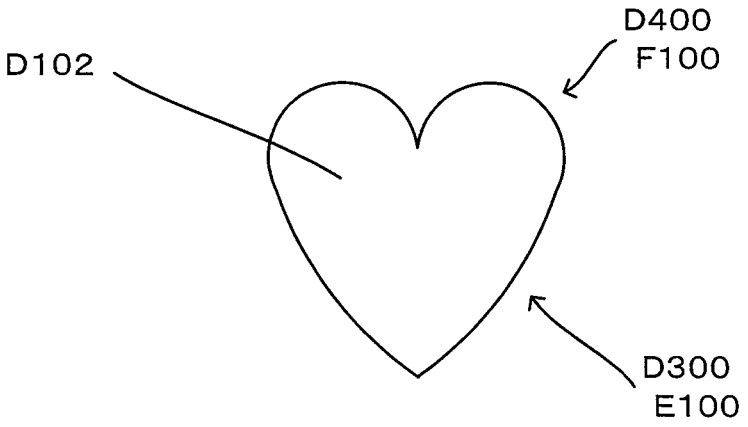
FIG. 5 is an explanatory drawing for illustrating the structure of the bonded part.

As shown in FIG. 5, the second bonded part D102 has the insertion-side region D300 which gets into contact with the projection G150 when the holder G100 is moved in the insertion direction A110*y* such that the long part G110 of the holder G100 is received in the receiving part C100. Further, the second bonded part D102 has the removal-side region D400 which gets into contact with the projection G150 when the long part G110 received in the receiving part C100 is moved in the removal direction A120*y*.

Figure 6:
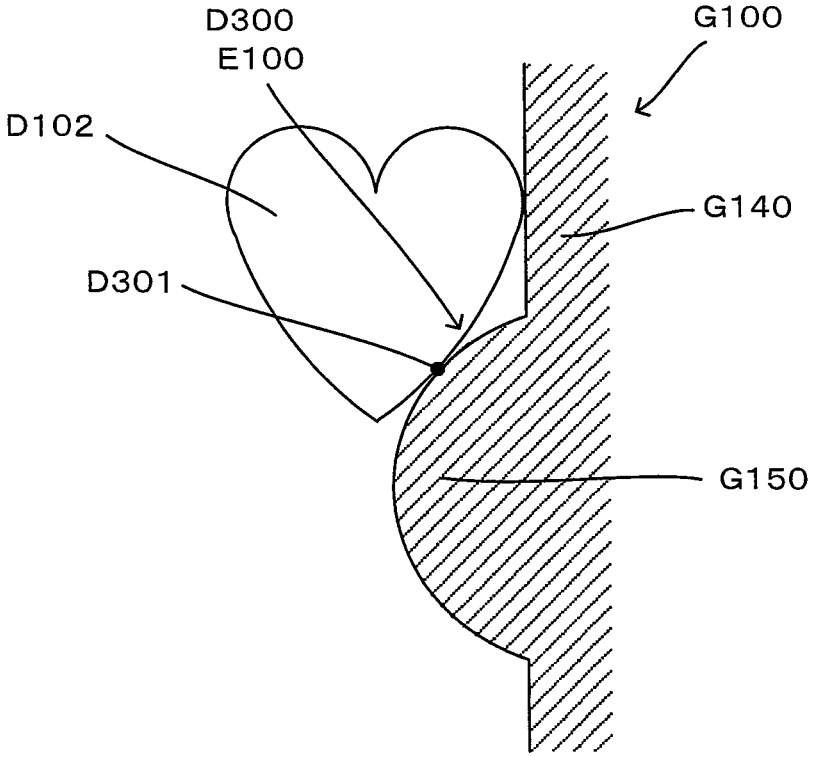
FIG. 6 is an explanatory drawing for illustrating the structure of an insertion-side region.
Figure 7:
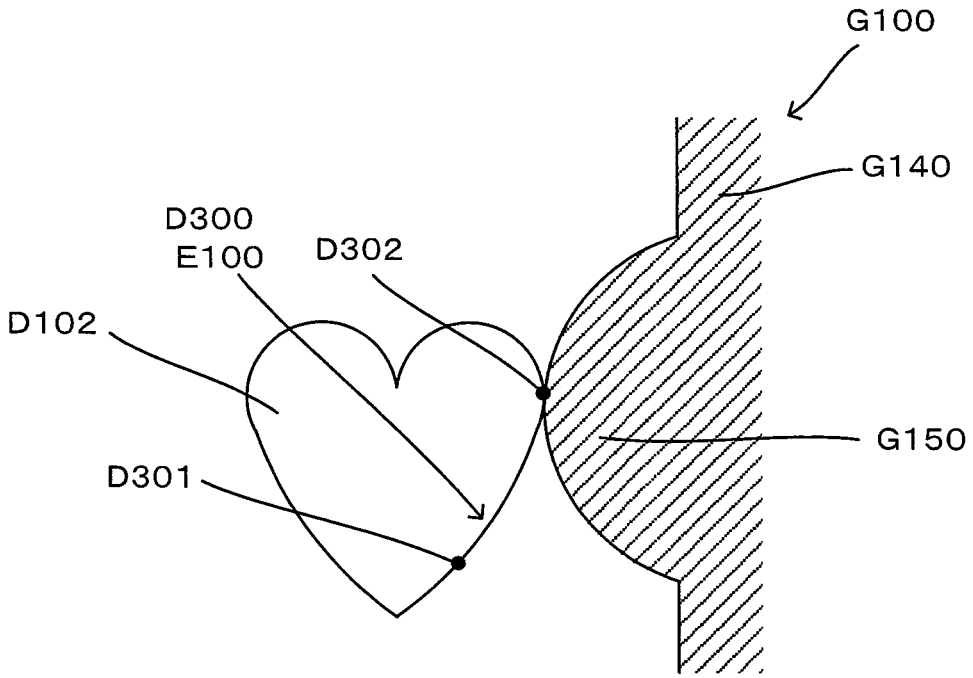
FIG. 7 is an explanatory drawing for illustrating the structure of the insertion-side region.
Figure 8:
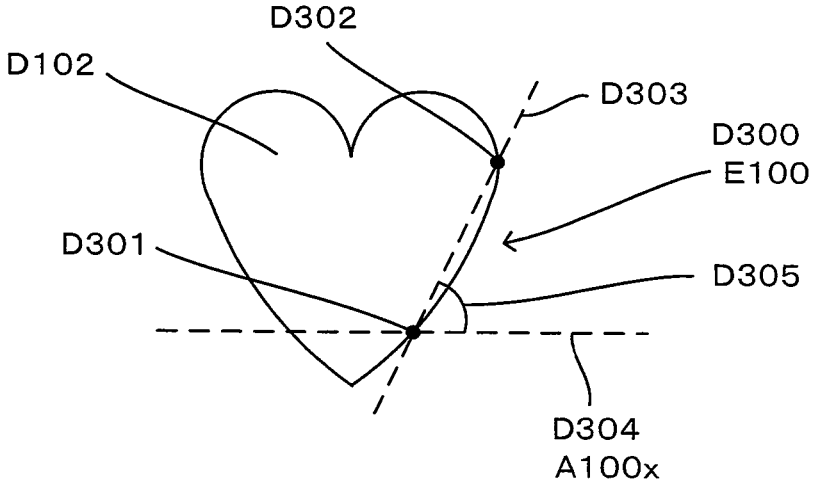
FIG. 8 is an explanatory drawing for illustrating the structure of the insertion-side region.

The insertion-side region D300 defines an insertion starting point D301 with which the projection G150 moving in the insertion direction A110*y* first gets into contact as shown in FIG. 6, and an insertion end point D302 which is an end point of contact of the projection G150 moving in the insertion direction A110*y* as shown in FIG. 7. Further, as shown in FIG. 8, the insertion-side region D300 defines a first insertion line D303 connecting the insertion starting point D301 and the insertion end point D302, a second insertion line D304 passing through the insertion starting point D301 along the second axis A100*x*, and an insertion angle D305 made by the first insertion line D303 and the second insertion line D304.

The insertion starting point D301, the insertion end point D302, the first insertion line D303, the second insertion line D304 and the insertion angle D305 are example embodiments that correspond to the "insertion starting point", the "insertion end point", the "first insertion line", the "second insertion line" and the "insertion angle", respectively, according to this invention.

Figure 9:
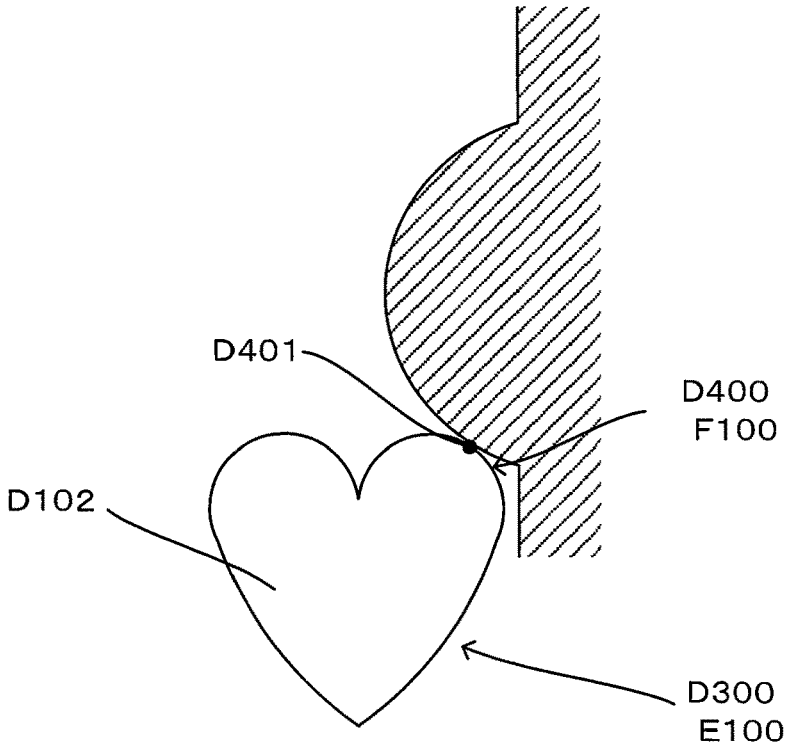
FIG. 9 is an explanatory drawing for illustrating the structure of a removal-side region.
Figure 10:
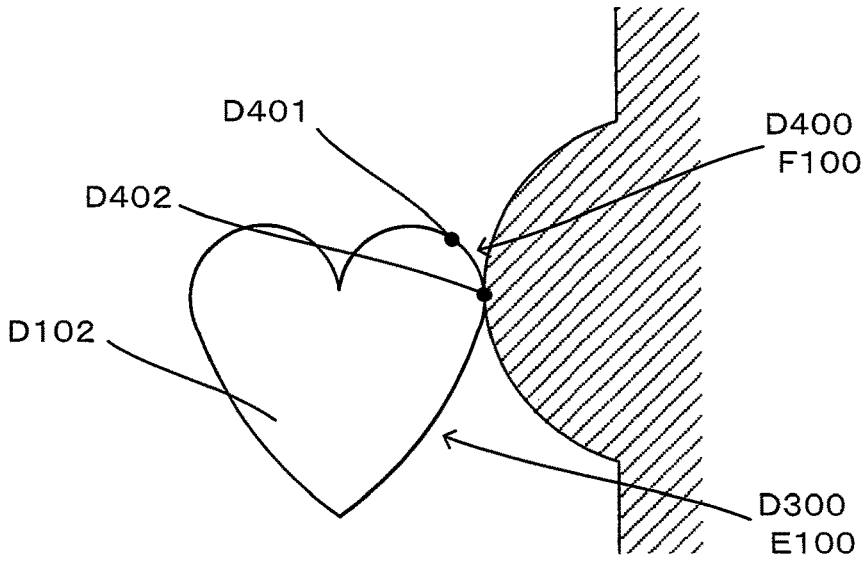
FIG. 10 is an explanatory drawing for illustrating the structure of the removal-side region.

The removal-side region D400 defines a removal starting point D401 with which the projection G150 moving in the removal direction A120*y* first gets into contact as shown in FIG. 9, and a removal end point D402 which is an end point of contact of the projection G150 moving in the removal direction A120*y* as shown in FIG. 10. Further, as shown in FIG. 11, the removal-side region D400 defines a first removal line D403 connecting the removal starting point D401 and the removal end point D402, a second removal line D404 passing through the removal end point D402 along the second axis A100*x*, and a removal angle D405 made by the first removal line D403 and the second removal line D404.

The removal starting point D401, the removal end point D402, the first removal line D403, the second removal line D404 and the removal angle D405 are example embodiments that correspond to the "removal starting point", the "removal end point", the "first removal line", the "second removal line" and the "removal angle", respectively, according to this invention.

Figure 11:
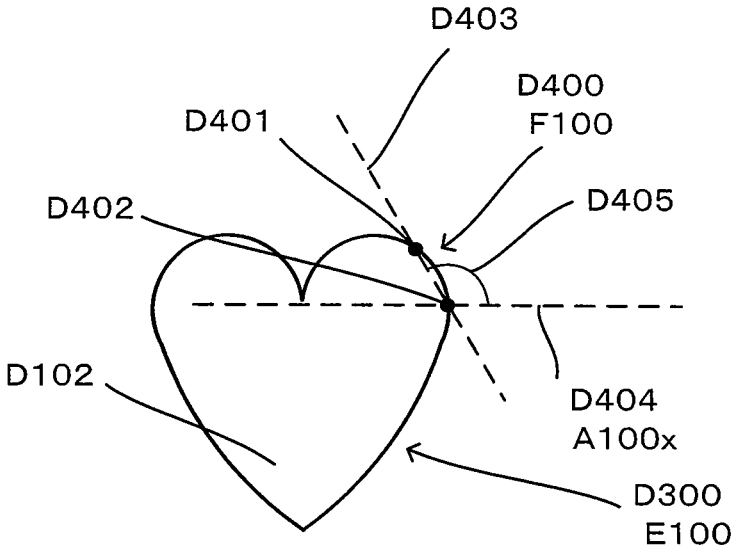
FIG. 11 is an explanatory drawing for illustrating the structure of the removal-side region.

The insertion angle D305 shown in FIG. 8 is formed to be smaller than the removal angle D405 shown in FIG. 11.

The insertion-side region D300 and the removal-side region D400 described above with reference to FIGS. 5 to 11 are formed in the first to third bonded parts D101 to D103. As shown in FIG. 12, the insertion-side regions D300 in the first to third bonded parts D101 to D103 are referred to as a first insertion-side region D310, a second insertion-side region D320 and a third insertion-side region D330, respectively. Further, the removal-side regions D400 in the first to third bonded parts D101 to D103 are referred to as a first removal-side region D410, a second removal-side region D420 and a third removal-side region D430, respectively.

The first insertion-side region D310, the second insertion-side region D320, the first removal-side region D410 and the second removal-side region D420 are example embodiments that correspond to the "first insertion-side region", the "second insertion-side region", the "first removal-side region" and the "second removal-side region", respectively, according to this invention.

(Description of the Holder)

Figure 16:
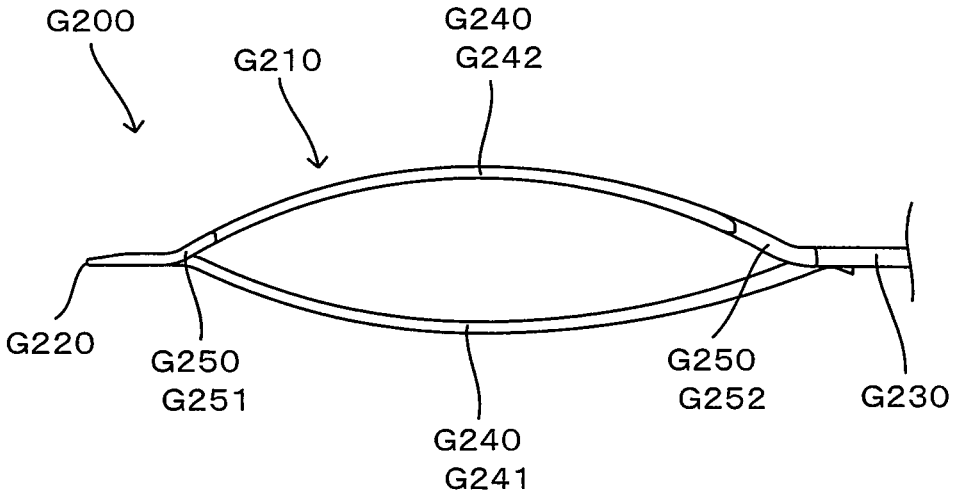
FIG. 16 is an explanatory drawing for illustrating the structure of a long part of the second holder.
Figure 17:
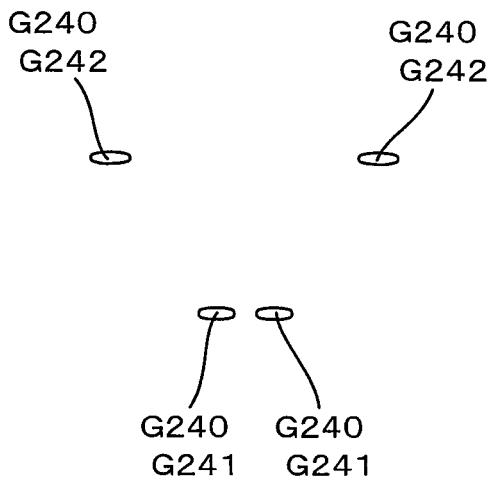
FIG. 17 is a sectional view taken along line II-II in FIG. 15.

The holders are now described with reference to FIGS. 13 to 17. FIGS. 13 and 14 show the first holder G100, and FIGS. 15 to 17 show the second holder G200.

As shown in FIG. 13, the first holder G100 has the long part G110 to be held in the receiving part C100 of the cleaning sheet B100, and a handle part G160 to be held by a user. The long part G110 has a tip G120, a base G130 and an extending part G140 extending between the tip G120 and the base G130. The extending part G140 extends in a bifurcated shape from the base G130. Thus, the long part G110 has the single base part G130 and has two each of the tips G120 and the extending parts G140. The extending part G140 has the projection G150. The projection G150 includes a tip-side projection G151 on the tip G120 side and a base-side projection G152 on the base G130 side. The handle part G160 has a front end G161, a rear end G162 and a grip G163 extending between the front end G161 and the rear end G162. The base G130 of the long part G110 and the front end G161 of the handle part G160 are configured to be removable from each other.

FIG. 14 is a side view of the long part G110 of the first holder G100. As shown in FIG. 14, the long part G110 has a tapered structure having a thickness gradually decreasing from the base 130 toward the tip G120, but macroscopically has a substantially flat shape.

As shown in FIG. 15, the second holder G200 has the long part G210 to be held in the receiving part C100 of the cleaning sheet B100, and a handle part G260 to be held by a user. The long part G210 has a tip G220, a base G230 and an extending part G240 extending between the tip G220 and the base G230. The extending part G240 extends in a bifurcated shape from the base G230. Thus, the long part G210 has the single base part G230 and has two each of the tips G220 and the extending parts G240.

The extending part G240 has a first extending part G241 and a second extending part G242. In the bifurcated extending part G240, the first extending parts G241 are configured to be located closer to each other, and the second extending parts G242 are configured to be located away from each other. More specifically, as shown in FIG. 15, the two first extending parts G241 are curved to protrude in a direction toward each other in the direction of the second axis A100*x*, and the two second extending parts G242 are curved to protrude in a direction away from each other in the direction of the second axis A100*x*.

The second extending part G242 of the extending part G240 has a projection G250. The projection G250 includes a tip-side projection G251 on the tip G220 side and a base-side projection G252 on the base G230 side. The handle part G260 has a front end G261, a rear end G262 and a grip G263 extending between the front end G261 and the rear end G262. The base G230 of the long part G210 and the front end G261 of the handle part G260 are configured to be removable from each other.

FIG. 16 is a side view of the long part G210 of the second holder G200. FIG. 17 is a sectional view taken along line II-II in FIG. 15. As shown in FIGS. 16 and 17, the first extending part G241 and the second extending part G242 are curved in a direction away from each other. Specifically, as shown in FIG. 16, the first extending part G241 is curved such that a central region of the first extending part G241 protrudes downward as viewed in FIG. 16, and the second extending part G242 is curved such that a central region of the second extending part G242 protrudes upward as viewed in FIG. 16. Thus, the long part G210 macroscopically has a substantially three-dimensional shape.

When a connection part between the base G130 and the extending parts G140 in the first holder G100 and a connection part between the base G230 and the extending parts G240 in the second holder G200 are aligned side by side on the second axis A100*x*, the base-side projection G152 of the first holder G100 and the base-side projection G252 of the second holder G200 are located in substantially the same region on the second axis A100*x*. At this time, however, the tip-side projection G151 of the first holder G100 is located toward the base G130 compared with the tip-side projection G251 of the second holder G200.

Therefore, the tip-side projection G151 and the base-side projection G152 are received in the first receiving regions C310 when the first holder G100 is attached to the cleaning sheet B100, while the tip-side projection G251 is received in the second receiving region C320 and the base-side projection G252 is received in the first receiving region C310 when the second holder G200 is attached to the cleaning sheet B100.

The first holder G100 and the second holder G200 are formed of a resin material.

(Description of Operation)

Figure 18:
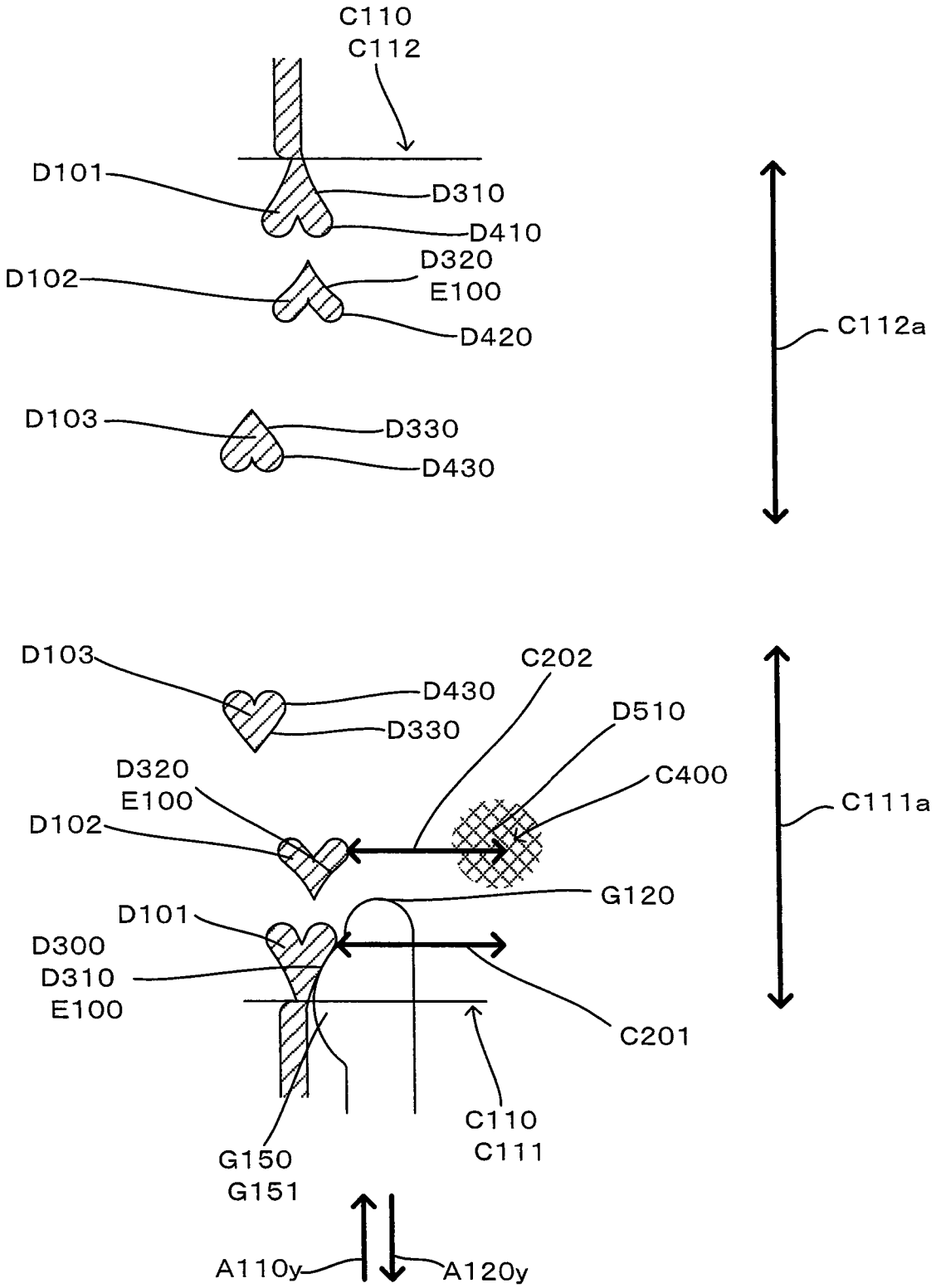
FIG. 18 is an explanatory drawing for illustrating the operation of a cleaning tool.
Figure 19:
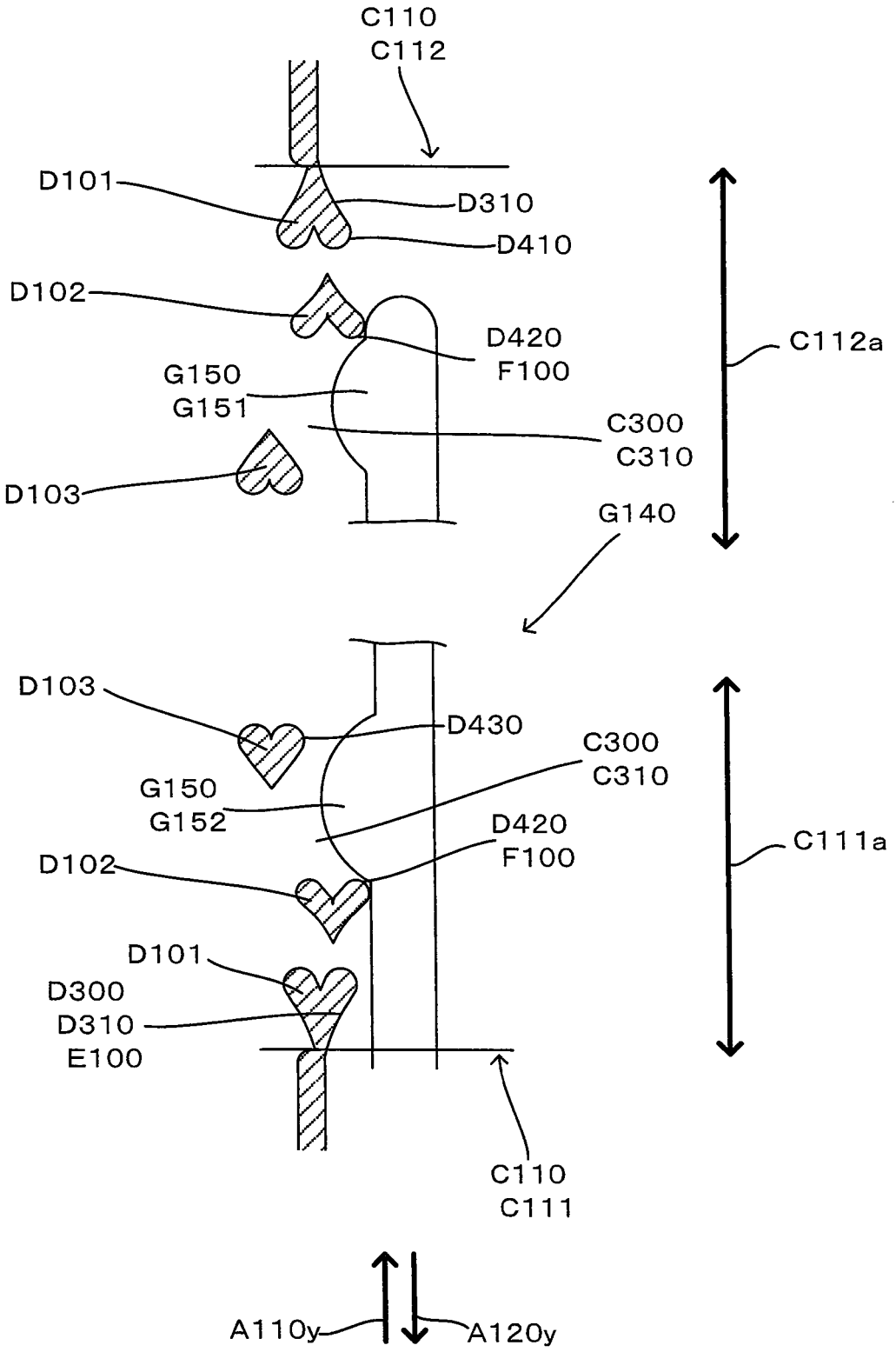
FIG. 19 is an explanatory drawing for illustrating the operation of the cleaning tool.
Figure 20:
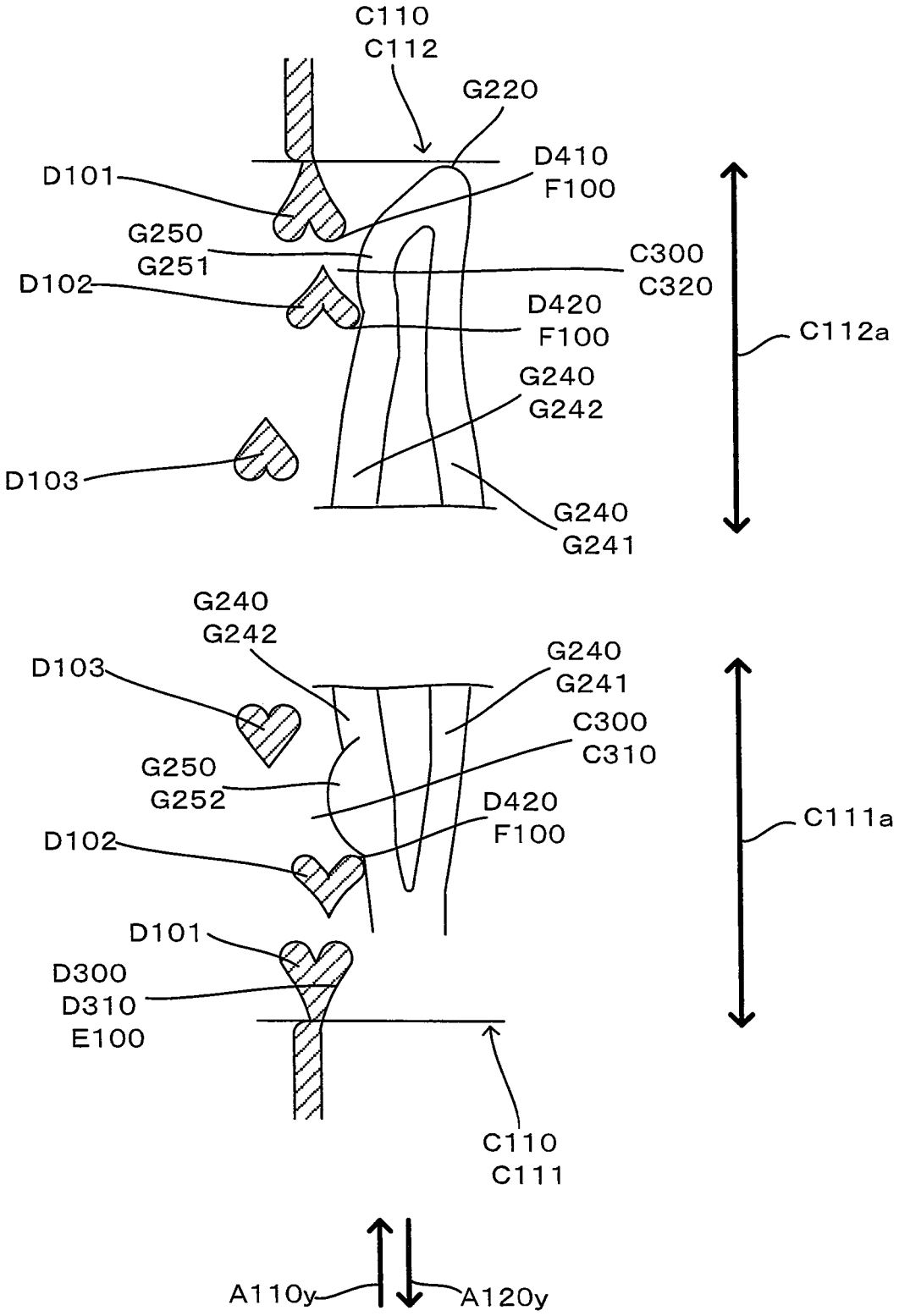
FIG. 20 is an explanatory drawing for illustrating the operation of the cleaning tool.

Operation of the cleaning tool according to this invention is now described with reference to FIGS. 18 to 20. FIGS. 18 and 19 are explanatory drawings for illustrating the operation when the first holder G100 is used, and FIG. 20 is an explanatory drawing for illustrating the operation when the second holder G200 is used. For the sake of convenience, operation of only one of the long parts G140 or G240 is shown and described.

First, as shown in FIG. 18, the tip G120 of the first holder G100 is inserted into the receiving part C100 of the cleaning sheet B100 through the first opening C111. It is to be noted here that the first bonded parts D101 define the first space region C201 so that the first opening C111 is formed wide in the direction of the second axis A100*x*. Therefore, the user can easily insert the tip G120 into the first opening C111.

When the user moves the first holder G100 in the insertion direction A110*y*, the tip-side projection G151 gets into contact with the first insertion-side region D310 of the first bonded part D101. At this time, through the first insertion-side region D310 formed at the above-described insertion angle D305, the user can smoothly insert the long part G110 of the first holder G100 into the receiving part C100 without large resistance.

The long part G110 is deformed inward (toward the sixth bonded part D106) through the first insertion-side region D310 having the insertion angle D305. The first bonded parts D101 and the second bonded parts D102 define the first space region C201 and the second space region C202, respectively. The second space region C202 is configured to have a smaller width than the first space region C201 in the direction of the second axis A100*x*. The long part G110 is moved from the first space region C201 to the second space region C202 by the user while being kept in the deformed state. Therefore, when the tip-side projection G151 of the long part G110 reaches the second space region C202 and passes through the second space region C202, the user can smoothly move the long part G110 without large resistance. Therefore, the first insertion-side region D310 of the first bonded part D101 can be said to be a guide part E100 for guiding the holder G100 from the first space region C201 to the second space region C202. The guide part E100 is an example embodiment that corresponds to the "guide part" according to this invention.

The long part G110 is moved through the second space region C202 by the user while being kept in the deformed state. Although the fifth bonded part D105 is formed in the second space region C202, the fifth bonded part D105 forming the high rigidity part C400 as described above prevents the receiving part C100 from largely deforming when the tip-side projection G151 passes over the second bonded part D102.

The long part G110 is further moved by the user and the tip-side projection G151 reaches the second opening-side region C112*a* through the first opening-side region C111*a*. At this time, the base-side projection G152 passes over the first and second bonded parts D101, D102 in the first opening-side region C111*a*. When the base-side projection G152 passes over the first and second bonded parts D101, D102, the guide part E100 and the high rigidity part C400 function in the same manner as in the above-described case of the tip-side projection G151.

FIG. 19 shows the state that insertion of the long part G110 into the receiving part C100 is completed. In this state, the tip-side projection G151 is received in the first receiving region C310 of the second opening-side region C112*a*. The base-side projection G152 is received in the first receiving region C310 of the first opening-side region C111*a*.

In this state, the user performs a cleaning operation with the cleaning tool. During cleaning operation, the positional relation between the cleaning sheet B100 and the long part G110 may be changed from that at the beginning due to friction between the cleaning sheet B100 and an object to be cleaned. Specifically, the holder G100 may tend to further move in the insertion direction A110*y*. In this case, the tip-side projection G151 gets into contact with the second removal-side region D420 of the second bonded part D102 in the second opening-side region C112*a*. At this time, the tip-side projection G151 is reliably brought into contact with the second bonded part D102 since the second bonded parts D102 define the second space region C202. The second removal-side region D420 is configured to have the removal angle D405 such that the tip-side projection G151 cannot easily pass over the second bonded part D102 in the second opening-side region C112*a*. Thus, the holder G100 is prevented from further moving in the insertion direction A110*y*. In other words, it can be said that the removal-side region D400 in the second opening-side region C112*a* forms a preventing part F100 for preventing the holder G100 inserted from the first opening C111 from being further inserted. The preventing part F100 is an example embodiment that corresponds to the "preventing part" according to this invention.

On the other hand, the holder G100 may tend to move in the removal direction A120*y*. In this case, the base-side projection G152 gets into contact with the second removal-side region D420 of the second bonded part D102 in the first opening-side region C111*a*. At this time, since the second bonded parts D102 define the second space region C202, the base-side projection G152 is reliably brought into contact with the second bonded part D102. The second removal-side region D420 is configured to have the removal angle D405 such that the base-side projection G152 cannot easily pass over the second bonded part D102 in the first opening-side region C111*a*. Thus, the holder G100 is prevented from moving in the removal direction A120*y*.

FIG. 20 shows the state that insertion of the second holder G200 into the receiving part C100 is completed. In this state, the tip-side projection G251 is received in the second receiving region C320 of the second opening-side region C112*a*. The base-side projection G252 is received in the first receiving region C310 of the first opening-side region C111*a*.

The functioning of the guide part E100 at the time of insertion of the long part G210 into the receiving part C100 and the functioning of the preventing part F100 during cleaning operation are respectively similar to those described above with reference to FIGS. 18 and 19 and will not be further elaborated here. Further, when the second holder G200 is attached to the cleaning sheet B100, the preventing part F100 is formed in both the first removal-side region D410 of the first bonded part D101 and the second removal-side region D420 of the second bonded part D102. Specifically, when the holder G200 tends to further move in the insertion direction A110*y* during cleaning operation, the tip-side projection G251 gets into contact with the first removal-side region D410 (the preventing part F100). Further, as described above, the second extending part G242 is curved to protrude outward in the direction of the second axis A100*x*. Therefore, when the holder G200 tends to further move in the insertion direction A110*y*, the curved part of the second extending part G242 gets into contact with the second removal-side region D420 (the preventing part F100). Thus, having the preventing part F100 formed in the first and second removal-side regions D410, D420, the second holder G200 is configured to be prevented from easily moving in the insertion direction A110*y* during cleaning operation.

Further, depending on the structure of the tip-side projection G251 or the second extending part G242 in the second holder G200, either one of the first removal-side region D410 and the second removal-side region D420 may function as the preventing part F100.

(Correspondences Between the Features of the Embodiment and the Features of the Invention)

The cleaning sheet B100 and the holder G100 are example embodiments that correspond to the "cleaning sheet" and the "holder", respectively, according to this invention. The sheet-like member B110, the bonded part D100 and the receiving part C100 are example embodiments that correspond to the "sheet-like member", the "bonded part" and the "receiving part", respectively, according to this invention. The insertion direction A110*y*, the removal direction A120*y*, the first axis A100*y* and the second axis A100*x* are example embodiments that correspond to the "insertion direction", the "removal direction", the "first axis" and the "second axis", respectively, according to this invention. The opening C110 and the receiving space C200 are example embodiments that correspond to the "opening" and the "receiving space", respectively, according to this invention. The separation bonded part D106 is an example embodiment that corresponds to the "separation bonded part" according to this invention. The first opening C111, the second opening C112, the first opening-side region C111*a* and the second opening-side region C112*a* are example embodiments that correspond to the "first opening", the "second opening", the "first opening-side region", the "second opening-side region", respectively, according to this invention. The first space region C201 and the second space region C202 are example embodiments that correspond to the "first space region" and the "second space region", respectively, according to this invention. The high rigidity part C400 is an example embodiment that corresponds to the "high rigidity part" according to this invention. The insertion-side region D300 and the removal-side region D400 are example embodiments that correspond to the "insertion-side region" and the "removal-side region", respectively, according to this invention. The insertion starting point D301, the insertion end point D302, the first insertion line D303, the second insertion line D304 and the insertion angle D305 are example embodiments that correspond to the "insertion starting point", the "insertion end point", the "first insertion line", the "second insertion line" and the "insertion angle", respectively, according to this invention. The removal starting point D401, the removal end point D402, the first removal line D403, the second removal line D404 and the removal angle D405 are example embodiments that correspond to the "removal starting point", the "removal end point", the "first removal line", the "second removal line" and the "removal angle", respectively, according to this invention. The first insertion-side region D310, the second insertion-side region D320, the first removal-side region D410 and the second removal-side region D420 are example embodiments that correspond to the "first insertion-side region", the "second insertion-side region", the "first removal-side region" and the "second removal-side region", respectively, according to this invention. The guide part E100 is an example embodiment that corresponds to the "guide part" according to this invention. The preventing part F100 is an example embodiment that corresponds to the "preventing part" according to this invention.

DESCRIPTION OF THE NUMERALS

A100*y* first axis
A110*y* insertion direction
A120*y* removal direction
A100*x* second axis
B100 cleaning sheet
B110 sheet-like member
B111 first sheet
B112 second sheet
B113 third sheet
B200 fiber bundle
B300 strip
B310 cut
C100 receiving part
C110 opening
C111 first opening
C111*a* first opening-side region
C112 second opening
C112*a* second opening-side region
C200 receiving space
C201 first space region
C202 second space region C300 projection receiving region
C310 first receiving region
C311 front end
C312 rear end
C320 second receiving region
C321 front end
C322 rear end
C400 high rigidity part
D100 bonded part
D101 first bonded part
D102 second bonded part
D103 third bonded part
D104 fourth bonded part
D105 fifth bonded part
D106 sixth bonded part (separation bonded part)
D110 first receiving region formation part
D111 first front end bonded part
D112 first rear end bonded part
D210 second receiving region formation part
D211 second front end bonded part
D212 second rear end bonded part
D300 insertion-side region
D301 insertion starting point
D302 insertion end point
D303 first insertion line D303
D304 second insertion line
D305 insertion angle
D310 first insertion-side region
D320 second insertion-side region
D330 third insertion-side region
D400 removal-side region
D401 removal starting point
D402 removal end point
D403 first removal line
D404 second removal line
D405 removal angle
D410 first removal-side region
D420 second removal-side region
D430 third removal-side region
E100 guide part
F100 preventing part
G100 holder (first holder)
G110 long part
G120 tip
G130 base
G140 extending part
G150 projection (first projection)
G151 tip-side projection
G152 base-side projection
G160 handle part
G161 front end
G162 rear end
G163 grip
G200 second holder
G210 long part
G220 tip
G230 base
G240 extending part
G241 first extending part
G242 second extending part
G250 projection (first projection)
G251 tip-side projection
G252 base-side projection
G260 handle part
G261 front end
G262 rear end
G263 grip

The invention claimed is:

1. A cleaning sheet configured to be attached to a holder, said cleaning sheet comprising:

sheet members, a receiving part at which the sheet members are superposed on each other and which is configured to receive the holder, and a bonded part at which the sheet members are bonded to each other and which defines an outer edge of the receiving part, wherein:

an insertion direction of the holder in the receiving part defines a first axis of the cleaning sheet, a direction opposite to the insertion direction in a direction of the first axis defines a removal direction, and a direction crossing the first axis defines a second axis of the cleaning sheet, the receiving part has an opening, and a receiving space formed contiguously to the opening and extending in the direction of the first axis, the receiving space has a first space region having a prescribed width and a second space region having a smaller width than the first space region, in the direction of the second axis, the first space region is disposed closer to the opening than the second space region in the direction of the first axis, the bonded part includes a first pair of bonded parts and a second pair of bonded parts, the first space region is disposed between the first pair of bonded parts in the direction of the second axis, the second space region is disposed between said second pair of bonded parts in the direction of the second axis, and the receiving space has two pairs of the first space region and the second space region, wherein one pair of the first space region and the second space region and another pair of the first space region and the second space region are configured to have line symmetry in the first axis.

2. The cleaning sheet as defined in claim 1, wherein:

the opening includes a first opening, and a second opening opposite to the first opening in the direction of the first axis, a first opening-side region includes the first opening and a second opening-side region includes the second opening, said one pair of the first space region and the second space region and said another pair of the first space region and the second space region are both formed in the first opening-side region and the second opening-side region.

3. The cleaning sheet as defined in claim 1, wherein:

the receiving part has a guide part configured to guide the holder, and the guide part comprises a region extending from the first space region to the second space region.

4. The cleaning sheet as defined in claim 1, wherein:

the receiving part has a high rigidity part having higher rigidity than other parts in the receiving part, and the high rigidity part is formed in the second space region.

5. The cleaning sheet as defined in claim 1, wherein:

the holder has a projection, and the receiving part forms a projection receiving region configured to receive the projection between the first pair of bonded parts and the second pair of bonded parts.

6. The cleaning sheet as defined in claim 1, wherein:

each bonded part of the first and second pairs of bonded parts has an insertion-side region configured to get into contact with the holder when the holder is moved in the insertion direction to be received in the receiving part, and a removal-side region configured to get into contact with the holder when the holder received in the receiving part is moved in the removal direction, the insertion-side region defines an insertion starting point configured to first get into contact with the holder when the holder is moved in the insertion direction, an insertion end point which is an end point configured to last get into contact with the holder when the holder is moved in the insertion direction, a first insertion line connecting the insertion starting point and the insertion end point, a second insertion line passing through the insertion starting point along the direction of second axis, and an insertion angle made by the first insertion line and the second insertion line, the removal-side region defines a removal starting point configured to first get into contact with the holder when the holder is moved in the removal direction, a removal end point which is an end point configured to last get into contact with the holder when the holder is moved in the removal direction, a first removal line connecting the removal starting point and the removal end point, a second removal line passing through the removal end point along the second axis, and a removal angle made by the first removal line and the second removal line, and the insertion angle is smaller than the removal angle.

7. The cleaning sheet as defined in claim 6, wherein:

the insertion-side region includes a first insertion-side region formed in the first pair of bonded parts and a second insertion-side region formed in the second pair of bonded parts, the removal-side region includes a first removal-side region formed in the first pair of bonded parts and a second removal-side region formed in the second pair of bonded parts.

8. The cleaning sheet as defined in claim 6, wherein the insertion-side region also serves as a guide part configured to guide the holder.

9. The cleaning sheet as defined in claim 6, wherein the opening includes a first opening, and a second opening opposite to the first opening in the direction of the first axis, a first opening-side region includes the first opening and a second opening-side region includes the second opening, and the removal-side region in the second opening-side region forms a preventing part configured to prevent the holder inserted from the first opening from being further inserted.

10. The cleaning sheet as defined in claim 1, wherein the receiving part has a separation bonded part separating the receiving space.

11. A cleaning tool, comprising:

a holder; and a cleaning sheet configured to be attached to the holder, wherein:

the holder has a grip part configured to be held by a user, and an elongated part, the cleaning sheet has sheet members, a receiving part at which the sheet members are superposed on each other and which is configured to receive the elongated part, and a bonded part at which the sheet members are bonded to each other and which defines an outer edge of the receiving part, an insertion direction of the elongated part in the receiving part defines a first axis of the cleaning sheet, a direction opposite to the insertion direction in a direction of the first axis defines a removal direction, and a direction crossing the first axis defines a second axis of the cleaning sheet, the receiving part has an opening, and a receiving space formed contiguously to the opening and extending in the direction of the first axis, the receiving space has a first space region having a prescribed width and a second space region having a smaller width than the first space region, in the direction of the second axis, the first space region is disposed closer to the opening than the second space region in the direction of the first axis, the bonded part includes a first pair of bonded parts and a second pair of bonded parts, the first space region is disposed between the first pair of bonded parts in the direction of the second axis, the second space region is disposed between the second pair of bonded parts in the direction of the second axis, and the receiving space has two pairs of the first space region and the second space region, wherein one pair of the first space region and the second space region and another pair of the first space region and the second space region are configured to have line symmetry in the first axis.

* * * * *